US008423405B1

(12) United States Patent
Gopalratnam et al.

(10) Patent No.: US 8,423,405 B1
(45) Date of Patent: Apr. 16, 2013

(54) ADVERTISEMENT SELECTION

(75) Inventors: Karthik Gopalratnam, San Francisco, CA (US); Levent Ertöz, Mountain View, CA (US); Myles Sussman, San Francisco, CA (US); Marc Berndl, San Francisco, CA (US); Dan Liu, Sunnyvale, CA (US); Sridhar Ramaswamy, Cupertino, CA (US); Nicholas C. Fox, San Francisco, CA (US); Jonathan G. Alferness, San Francisco, CA (US); Adam I. Juda, New York, NY (US)

(73) Assignee: Google Inc., Mountain View, CA (US)

( * ) Notice: Subject to any disclaimer, the term of this patent is extended or adjusted under 35 U.S.C. 154(b) by 212 days.

(21) Appl. No.: 12/917,106

(22) Filed: Nov. 1, 2010

(51) Int. Cl.
*G06Q 30/00* (2012.01)

(52) U.S. Cl.
USPC ..... 705/14.4

(58) Field of Classification Search ..... 705/14
See application file for complete search history.

(56) References Cited

U.S. PATENT DOCUMENTS

| | | | | |
|---|---|---|---|---|
| 2005/0154718 | A1* | 7/2005 | Payne et al. | 707/3 |
| 2007/0027743 | A1* | 2/2007 | Carson et al. | 705/10 |
| 2007/0112840 | A1* | 5/2007 | Carson et al. | 707/102 |
| 2007/0150348 | A1* | 6/2007 | Hussain et al. | 705/14 |
| 2007/0156887 | A1* | 7/2007 | Wright et al. | 709/224 |
| 2007/0226060 | A1* | 9/2007 | Do | 705/14 |
| 2008/0306819 | A1* | 12/2008 | Berkhin et al. | 705/14 |
| 2009/0063278 | A1* | 3/2009 | Song et al. | 705/14 |
| 2011/0131093 | A1* | 6/2011 | Behroozi et al. | 705/14.52 |
| 2011/0191315 | A1* | 8/2011 | Neumeyer et al. | 707/706 |

* cited by examiner

*Primary Examiner* — Matthew L Hamilton
(74) *Attorney, Agent, or Firm* — Leason Ellis LLP

(57) ABSTRACT

In general, in one aspect, a first request to provide one or more advertisements on a first web page is received, the first web page comprising one or more items of web content related to a query. A first quality score is calculated for a first advertisement included in a set of one or more candidate advertisements. The first advertisement is presented on the first web page based at least in part on the first quality score. A second request is received to provide one or more advertisements on a second web page, the second web page comprising one or more different items of web content related to the query. A second quality score for the first advertisement is calculated based at least in part on the previous presentation of the first advertisement. It is determined whether to present the first advertisement on the second web page based at least in part on the second quality score.

20 Claims, 4 Drawing Sheets

ADVERTISEMENT SELECTION

TECHNICAL FIELD

This disclosure relates to selecting and arranging advertisements for display on a web page.

BACKGROUND

Content items, e.g., advertisements, can be identified by a search engine in response to a query. The query can include one or more search terms, and the search engine can identify and rank the content items based on, for example, the search terms, e.g., keywords, in the query and one or more parameters associated with the content item.

In some online advertising systems, advertisers pay for their advertisements on a cost-per-click basis. Advertisers can select the maximum cost-per-click the advertisers are willing to pay for each click of an advertisement. The cost-per-click charged for an identified advertisement can be calculated based on the other advertisements rated or positioned below the current advertisements and a click-through rate for the current advertisement in an auction process.

Determining an actual cost-per-click for the advertisements that is based on the other advertisements (e.g., ranked below the current advertisement) can result in an optimization of advertising revenue. Some advertising systems charge the maximum cost-per-click. However, other optimization processes can also be used to select a subset of advertisements to be displayed and the actual cost-per-click to be charged.

SUMMARY

Systems, methods and apparatus for redetermining quality scores for subsequently displayed web pages are disclosed.

In one aspect, a first request to provide one or more advertisements on a first web page is received, the first web page including one or more items of web content related to a query. A first quality score is calculated for a first advertisement included in a set of one or more candidate advertisements. The first advertisement is presented on the first web page based at least in part on the first quality score. A second request is received to provide one or more advertisements on a second web page, the second web page including one or more different items of web content related to the query. A second quality score for the first advertisement is calculated based at least in part on the previous presentation of the first advertisement. It is determined whether to present the first advertisement on the second web page based at least in part on the second quality score.

Aspects can include one or more of the following features. Calculating the second quality score includes adjusting the second quality score based on one or more previous instances in which the first advertisement was presented on consecutive web pages. Calculating the second quality score includes applying a penalty to the second quality score based on the previous presentation of the first advertisement. The penalty is increased for each quality score calculation subsequent to the calculation of the second quality score. The penalty decreases a value of the second quality score. A constant minimum price is maintained that is associated with the first advertisement for use in an auction associated with a presentation of the second web page. The first advertisement is presented on the second web page as a result of the determination when the second quality score of the first advertisement exceeds a product of bids and quality scores associated with one or more additional advertisements. The first advertisement is presented on the second web page as a result of the determination when a second product of a bid and a second quality score exceeds a threshold. The first web page and the second web page each include a first advertisement space for presenting one or more advertisements and a second advertisement space for presenting one or more advertisements, the first advertisement space being located at a top portion of the first web page and the second web page, and the second advertisement space being located on a side portion of the first web page and the second web page. Advertisements presented on the first web page in the second advertisement space are not presented in the second advertisement space on the second web page. The first advertisement space is arranged above the one or more items of web content, and the second advertisement space is arranged next to the one or more items of web content. The web content includes one or more search results.

In general, the techniques disclosed herein provide one or more of the following advantages. Redetermining quality scores for different (e.g., subsequently displayed) page of search results based on a previous presentation of an advertisement improves an advertising management system's ability to select and serve advertisements. Determining subsequent quality scores based on a previous presentation of an advertisement further reduces the likelihood that an ineffective advertisement will be repeatedly shown, and increases the likelihood that effective advertisements will not be needlessly prohibited from being presented on subsequent web pages.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers indicate like elements.

DETAILED DESCRIPTION

Figure 1:
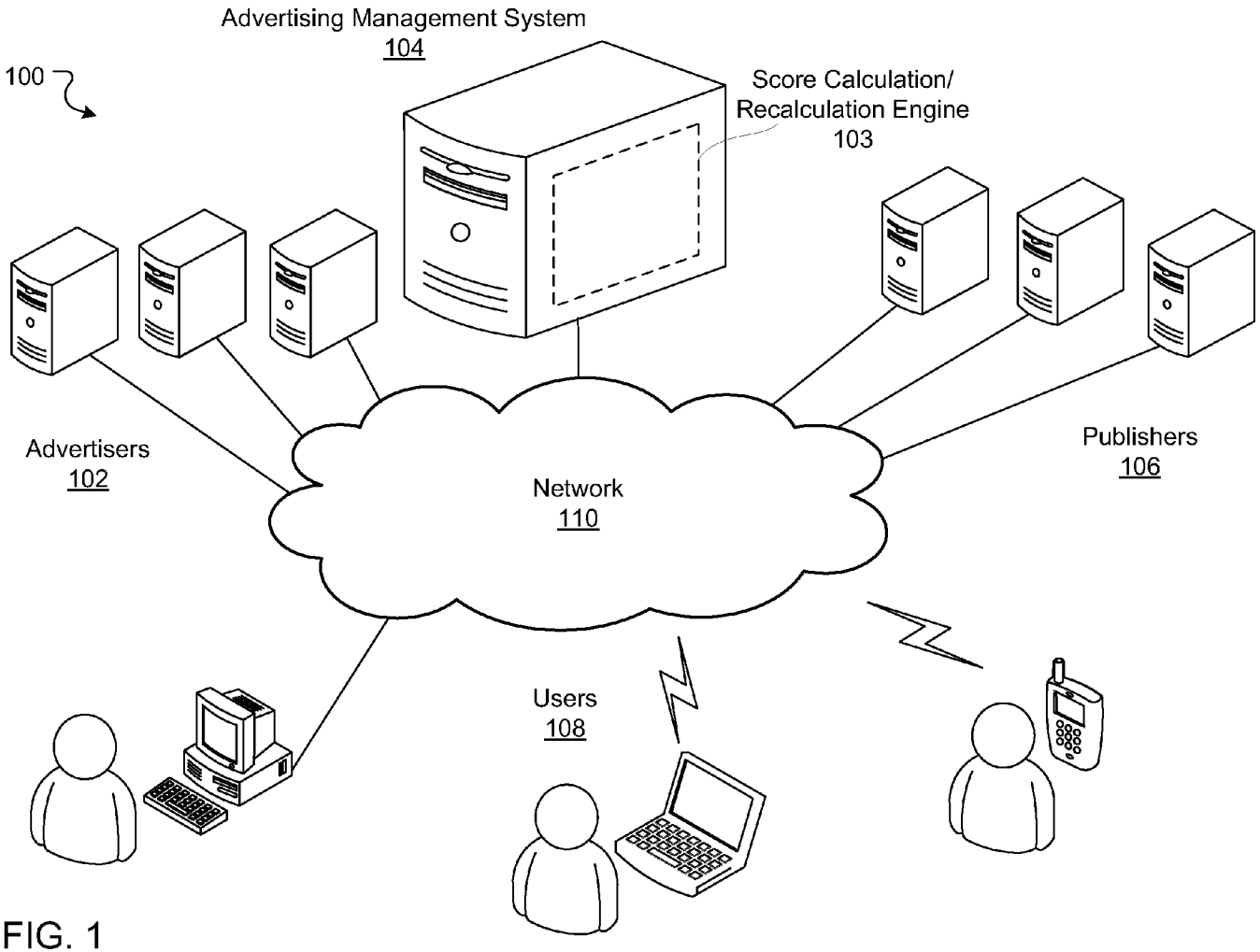
FIG. 1 is a block diagram of an exemplary online advertising system.

FIG. 1 is a block diagram of an exemplary online advertising system 100. In some implementations, one or more advertisers 102 can directly, or indirectly, enter, maintain, and track advertisement (sometimes referred to as an "ad") information in an advertising management system 104. The ads may be in the form of graphical ads, such as banner ads, text only ads, image ads, audio ads, video ads, ads combining one of more of any of such components, etc. The ads may also include embedded information, such as a links, meta-information, and/or machine executable instructions.

Briefly, a publisher may provide both search results and advertisements that span multiple pages (e.g., five pages of search results that relate to a single query). The decision of which advertisements to display on pages subsequent to the first page of search results (e.g., the second, third, fourth, or fifth pages) can be based at least in part on displays of a particular advertisement on a prior web page. For example, if an advertisement was presented on a first page of search results, the advertising management system 104 may include this prior presentation in determining whether to display the same advertisement on a subsequent page of search results. While this disclosure may refer generally refer to the advertisement management system 104, in some examples, the advertising management system 104 can include a score calculation/recalculation engine 103 that can perform operations that relate to, for example, calculating quality scores for advertisements, and calculating subsequent quality scores for advertisements that have been previously presented on prior web pages.

In general, an ad refers to any form of communication in which one or more products, services, ideas, messages, people, organizations or other items are identified and promoted (or otherwise communicated). Ads are not limited to commercial promotions or other communications. An ad may be a public service announcement or any other type of notice, such as a public notice published in electronic press or a broadcast. An ad may be referred to or include sponsored content. One or more publishers 106 may submit requests for ads to the system 104. The system 104 responds by sending ads to the requesting publisher 106 (or directly to an end user) for placement on one or more of the publisher's web properties (e.g., websites and other network-distributed content). The ads can include embedded links to landing pages, e.g., pages on the advertisers 102 websites, that a user is directed to when the user clicks an ad presented on a publisher website. Though reference is made to advertising, other forms of content, including other forms of sponsored content, can be delivered by the system 100.

Other entities, such as the users 108 and the advertisers 102, can provide usage information to the system 104, such as, for example, whether or not a conversion or click-through related to an ad has occurred. This usage information can include measured or observed user behavior related to ads that have been served (e.g., presented to the user on a user interface of the user's computer, mobile telephone, or other computing device. For example, in contrast to an impression which occurs when a user views one of the ads (such as when a page of content including the ad is displayed and/or rendered to the user), a "click-through" may be said to occur when a user selects a presented ad by clicking on the ad, embedded hypertext links, executable code, and/or any type of user selection related to the presented ad, where the click or another type of selection typically directs the user to the advertiser's web site or the advertiser's online or real world presence. A conversion may be said to occur when a user consummates a transaction related to a previously served ad. What constitutes a conversion may vary from case to case and may be determined in a variety of ways. For example, it may be the case that a conversion occurs when a user clicks on an ad, is referred to the advertiser's web page, and consummates a purchase there before leaving that web page. Alternatively, a conversion may be defined as a user being shown an ad, and making a purchase on the advertiser's web page within a predetermined time (e.g., within seven days). Many other definitions of what constitutes a conversion are possible. In response to a conversion or other action, the system 104 can perform financial transactions, such as crediting the publishers 106 and charging the advertisers 102 based on the usage information.

A computer network 110, such as a local area network (LAN), wide area network (WAN), the Internet, or a combination thereof, connects the advertisers 102, the system 104, the publishers 106, and the users 108.

One example of a publisher 106 is a general content server that receives requests for content (e.g., articles, discussion threads, music, video, graphics, search results, web page listings, information feeds, etc.), and retrieves the requested content in response to the request. The content server (or a user that is accessing the content source by way of a redirect) may submit a request for ads to an ad server in the system 104. The ad request may include a number of ads desired. The ad request may also include content request information. This information can include the content itself (e.g., page or other content document), a category corresponding to the content or the content request (e.g., arts, business, computers, arts-movies, arts-music, etc.), part or all of the content request, content age, content type (e.g., text, graphics, video, audio, mixed media, etc.), geo-location information, etc.

In some implementations, the content server can combine the requested content with one or more of the ads provided by the system 104. This combined content and ads can be sent to the user 108 that requested the content for presentation in a viewer (e.g., a browser or other content display system). Alternatively, the content can be combined at a user's device (e.g., by combining in a user's browser content from the content source with ads provided by the system 104). The content server can transmit information about the ads back to the ad server, including information describing how, when, and/or where the ads are to be rendered (e.g., in HTML or JavaScript™).

Another example of a publisher 106 is a search service. A search service can receive queries for information based on one or more user-entered keywords. In response, the search service can retrieve relevant search results from an index of documents (e.g., from an index of web pages). An exemplary search service is described in the article S. Brin and L. Page, "The Anatomy of a Large-Scale Hypertextual Search Engine," Seventh International World Wide Web Conference, Brisbane, Australia and in U.S. Pat. No. 6,285,999, both of which are incorporated herein by reference each in their entirety. Search results can include, for example, lists of web page titles, snippets of text extracted from those web pages, and hypertext links to those web pages, and may be grouped into a predetermined number of (e.g., ten) search results.

The search service can submit a request for ads to the system 104. The request may include a number of ads desired. This number may depend on the search results, the amount of screen or page space occupied by the search results, the size and shape of the ads, etc. In some implementations, the number of desired ads will be from one to ten, or from three to five. The request for ads may also include the query (as entered or parsed), information based on the query (such as geo-location information, whether the query came from an affiliate and an identifier of such an affiliate), and/or information associated with, or based on, the search results. Such information may include, for example, identifiers related to the search results (e.g., document identifiers or "docIDs"), scores related to the search results (e.g., information retrieval ("IR") scores), snippets of text extracted from identified documents (e.g., web pages), full text of identified documents, feature vectors of identified documents, etc. In some implementations, IR scores can be computed from, for example, dot products of feature vectors corresponding to a query and a document, page rank scores, and/or combinations of IR scores and page rank scores, etc.

The search service can combine the search results with one or more of the ads provided by the system 104. This combined information can then be provided to the user 108 that requested the content. The search results can be maintained as distinct from the ads, so as not to confuse the user between paid advertisements and presumably neutral search results.

Finally, the search service can transmit information about the ad and when, where, and/or how the ad was to be rendered back to the system 104.

As can be appreciated from the foregoing, the advertising management system 104 can serve publishers 106, such as content servers and search services. The system 104 permits serving of ads targeted to documents or content served by content servers. For example, a network or inter-network may include an ad server serving targeted ads in response to requests from a search service with ad spots for sale. Suppose that the inter-network is the World Wide Web. The search service crawls much or all of the content. Some of this content will include ad spots (also referred to as "inventory") available. More specifically, one or more content servers may include one or more documents. Documents may include web pages, email, content, embedded information (e.g., embedded media), meta-information and machine executable instructions, and ad spots available. The ads inserted into ad spots in a document can vary each time the document is served or, alternatively, can have a static association with a given document.

In some examples, the advertisement management system 104 may include an auction process to select advertisements. Advertisers may be permitted to select, or bid, an amount the advertisers are willing to pay for each click of an advertisement, e.g., a cost-per-click amount an advertiser pays when, for example, a user clicks on an advertisement. The cost-per-click can include a maximum cost-per-click, e.g., the maximum amount the advertiser is willing to pay for each click of advertisement based on targeting criteria (e.g., one or more keywords). For example, advertisers A, B, and C all select, or bid, a maximum cost-per-click of $0.50, $0.75, and $1.00, respectively. The maximum amount advertiser A will pay for a click is $0.50, the maximum amount advertiser B will pay is $0.75, and the maximum amount advertiser C will pay is $1.00.

The rank of an advertisement that is displayed can be determined by combining (e.g., multiplying) the maximum cost-per-click for the advertisement by a quality score of the advertisement. The quality score can represent the amount of user interest a particular advertisement is likely to generate given a particular query. Stated differently, the quality score is a metric that captures a relevance of an advertisement to a query (e.g., using click-through-rate as a signal). The advertisement can then be placed among other advertisements in order of increasing or decreasing rank based on the quality scores. For example, suppose the quality score of advertisers A, B, and C are "3," "1," and "1," respectively. The rank of advertiser A, B, and C can be determined as follows:

A: Rank=quality score×maximum cost-per-click=3.0×$0.50=1.50

B: Rank=quality score×maximum cost-per-click=1.0×$0.75=0.75

C: Rank=quality score×maximum cost-per-click=1.0×$1.00=1.00

The advertisers can be ranked in decreasing order as follows:

1. A
2. C
3. B

The advertisements can also be priced and ordered according to a second price auction. In addition to the cost-per-click of the advertisement and the quality score of the advertisement, a second price auction may compute the price of an advertisement at bidding time by considering the amount selected or bid by the advertiser directly ranked below a given advertisement. For example, the "second price" (sometimes referred to as an "actual cost per click") of an advertisement can be the price that is necessary to keep the advertisement's position above the next advertisement. To determine the second price, the system 104 can determine how much the advertiser in position 1 would have to pay to give them a rank equal to the advertiser in position 2, and then the system 104 adds a unit amount, e.g., $0.01, to this determined amount.

To determine how much the advertiser in position 1 would have to pay to give them a rank equal to the advertiser in position 2, the rank of position 2 can be divided by the quality score of position 1 and $0.01 can be added to that amount. The last advertiser in the list can pay a minimum cost-per-click to hold the position in the list. For example, suppose the minimum cost-per-click is $0.20. The second price of advertisers A, B, and C can be determined as follows:

A: C's rank/A's quality score=1/3=$0.33+$0.01=$0.34

C: B's rank/C's quality score=0.75/1=$0.75+$0.01=$0.76

B: minimum cost-per-click=$0.20

In this example, A would only have to pay $0.34 to hold the first position in the list of advertisements. C would have to pay $0.76 to hold the second position. Advertiser B would be required to pay the minimum cost-per-click amount of $0.20.

Another metric for ranking and valuing advertisements is effective cost-per-thousand impressions (eCPM). The eCPM value represents the estimated earnings for every 1000 "impressions" an advertiser receives. An impression refers to the number of times a web page or pages containing a particular advertisement are shown to page visitors.

When the cost-per-click is known, such as in the auction scheme described above, eCPM can be calculated according to the following formula:

$$eCPM=1000\times CPC\times(\text{Probability of Click})$$

The probability of click factor can be supplied based on historical data associated with an advertisement, a merchant, industry-wide data, or other factors. Thus, when an advertiser provides a cost-per-click bid, the eCPM formula can represent an advertiser's estimated earnings for every 1000 impressions received. Second price auctions such as those described above can also use eCPM values to create a second price value for an advertisement.

Figure 2:
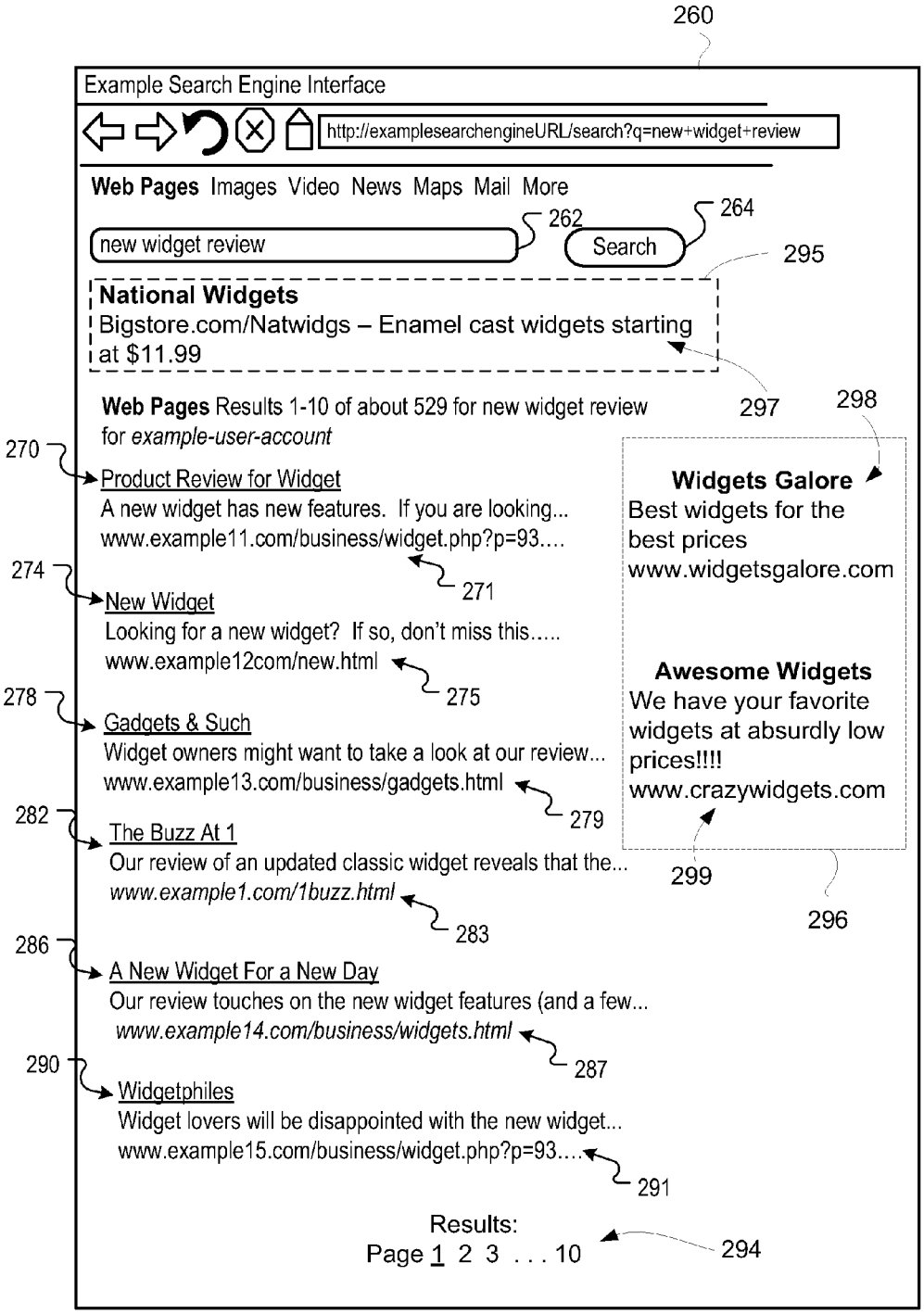
FIG. 2 illustrates an exemplary search results web page.

FIG. 2 is a screen shot of a portion of an exemplary search results page 260. The screen shot of a search results page 260 that includes multiple items of web content (e.g., search results) arranged in combination with advertisements. In some examples, a publisher may provide both search results and advertisements that span multiple pages (e.g., five pages of search results that relate to a single query). The decision of which advertisements to display on pages subsequent to the first page of search results (e.g., the second, third, fourth, or fifth pages) can be based at least in part on displays of a particular advertisement on a prior web page. For example, if an advertisement was presented on a first page of search results, the advertising management system 104 may include this prior presentation in determining whether to display the same advertisement on a subsequent page of search results.

The search results page 260 includes a query input field 262 and a search button 264. Entry of a query into the query input field 262 and selection of the search button 264 causes the query to be submitted to a search engine (e.g., publishers 106) which, in turn, provides the search results page 260. In this example, the search results include search results 270, 274, 278, 282, 286 and 290. Each of the search results 270, 274, 278, 282, 286 and 290 includes a respective resource locator (e.g., a URL) 271, 275, 279, 283, 287 and 291 specifying the location of a corresponding resource. Each corresponding resource may hosted by one or more of the publishers 106.

The search results page 260 also includes a top advertising location 295 and a side advertising location 296. The top advertising location 295 includes an advertisement 297, and the side advertising location 296 includes multiple advertisements. In this example, the side advertising location 296 includes two advertisements 298, 299. All of the search results 270, 274, 278, 282, 286 and 290 and the advertisements 297-299 are in some way relevant to the query "new widget review" provided in query input field 262. For example, the search result 270 (which, in some examples, may be considered the "best" or "most relevant" result) is related to the query in that it provides products reviews for a widget. Similarly, the advertisement 296 advertises an opportunity to purchase a widget for $11.99. As discussed above, the advertisements 297-299 are selected by the advertising management system 104 based on both their quality scores (which may include, among other things, the relevance of the advertisements to the query and/or historical click-through rates) and their associated bid amounts. In some examples, the top advertising location 295 and the side advertising location 296 may be associated with advertisements of a particular quality. For example, the top advertising location 295 may be associated with (e.g., reserved for, or configured to present) the best advertisement (e.g., the advertisement that is most likely to be of interest to the user), while the side advertising location may be associated with lesser advertisements (e.g., the advertisements that are less likely to be of interest to the user).

The search results page 260 also includes a page identifier 294. In this example, the page identifier 294 indicates that the results page 260 is the first page of multiple pages of search results. Users may proceed to different pages of search results by activating controls associated with the page identifier 294 (e.g., by clicking the "2" icon, a user may advance to the second page of search results). Advancing to the second page of search results may cause the results page 260 to present one or more additional search results (e.g., in an order of descending relevance or quality) as well as one or more additional advertisements. In some examples, the advertising management system 104 uses enhanced techniques to select and present advertisements on subsequent pages of web sites. For example, the system can penalize or credit an advertisement based on its previous display on another page of the search results.

Figure 3:
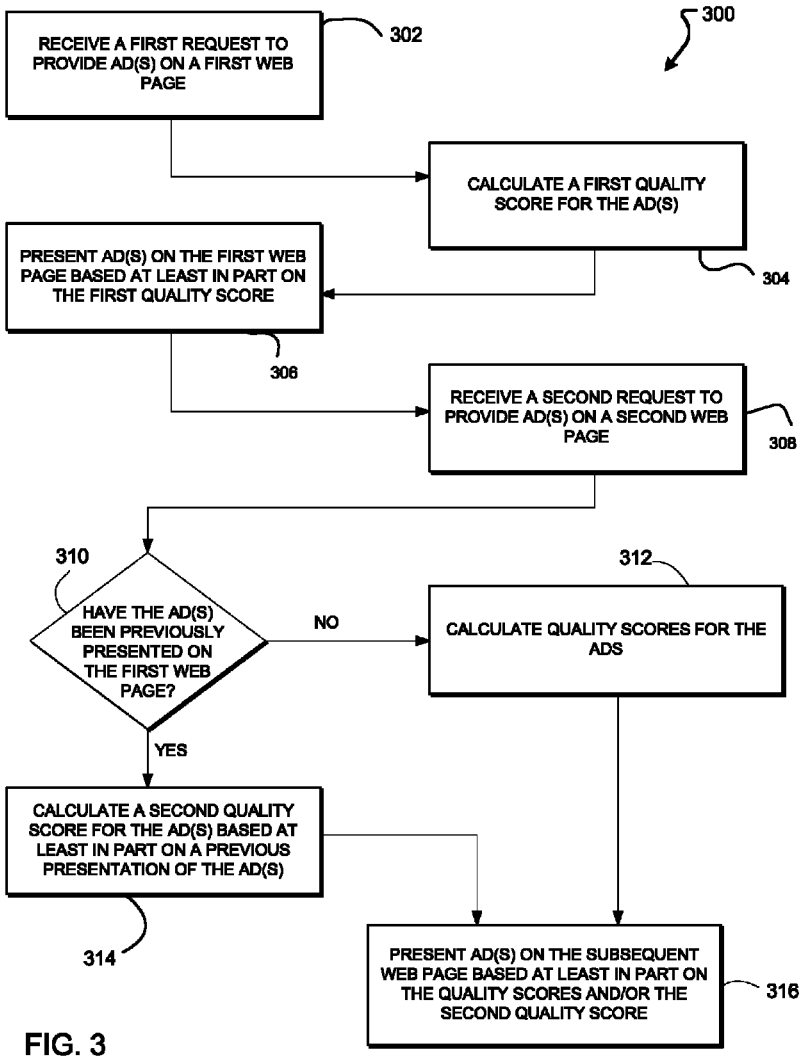
FIG. 3 is an flow chart that illustrates an exemplary process for serving one or more advertisements.

FIG. 3 shows an exemplary process 300 for selecting and presenting advertisements for display on a subsequent page of a web site. The exemplary process 300 determines whether to select an advertisement for presentation on a subsequent web page based on whether that same advertisement was presented on a prior web page.

The process 300 may begin when the advertising management system 104 receives a request to provide one or more advertisements on a first web page (302). As in the example of FIG. 2 above, the first web page can include a page of search results that relate to a query. However, other types of web pages can also use these techniques. For example, determining which advertisements to present on a second web page can be based at least in part on which advertisements were presented on a first web page, even if the web pages are not related. The first web page may include one or more advertisement locations for presenting one or more advertisements.

In response to receiving the first request, the advertising management system 104 calculates first quality scores for the advertisements (304). The advertising management system 104 calculates the first quality score for a group of advertisements that are in contention to be selected for presentation on the first web page. The quality score for the first page is calculated as a baseline quality score, and the quality score of the "next page" could be calculated like the baseline score but with other factors considered. The advertisements that are in contention to be selected for presentation on the first web page are sometimes referred to as candidate advertisements.

After calculating the first quality scores for the candidate advertisements, the advertising management system 104 provides one or more advertisements for presentation on the first web page based at least in part on the first quality scores (306). Presenting the advertisements based at least in part on the first quality scores may include selecting the "best" (e.g., the most relevant and/or the most profitable) advertisements from among the candidate advertisements for inclusion on the first web page (e.g., through the auction process described above). Presenting the advertisements may also include determining one or more advertisement locations in which to present the selected advertisements.

Thus, in general, portions 302, 304, and 306 of the process 300 provide techniques for selecting and presenting advertisements in a manner similar to the techniques described above with regard to FIG. 1. That is, a request for advertisements is received, quality scores are calculated for candidate advertisements, and one or more advertisements are selected from the candidate advertisements to serve on the web page based in part on the quality scores.

After the advertisements have been presented on the first web page, the advertising management system 104 receives a second request to provide advertisements on a second web page (308). In some examples, the second web page is a subsequent page of search results that relate to the same query and, like the first web page, the subsequent page of search results may include one or more advertisement locations meant to accommodate advertisements that relate to the query. For example, if a user activated (e.g., clicked) the "2" control within the page identifier 294 (FIG. 2), a second page of search results (a "subsequent page") can be generated and/or displayed that relate to the original query (e.g., the query associated with the first page of search results), as well as one or more advertisements that relate to the query. The advertising management system 104 may receive the second request in response to the user activation of a control on the first web page, or such a user action may include the second request. While an exemplary subsequent web page has been described as being page "2" of a set of search results, the subsequent web page can also be a previous web page that relates to the same query, or simply a different web page that relates to the same query (e.g., a web page that does not sequentially precede or follow the first web page).

After receiving the second request, the advertising management system 104 determines whether the advertisements (e.g., the candidate advertisements) have been previously presented on the first web page (310). That is, the advertising management system 104 identifies advertisements (if any) among the candidate advertisements that were presented on the first web page in combination with the web content (e.g., the search results). If the advertisements were not previously presented on the first web page (NO), the advertising management system 104 again calculates (312) quality scores for the advertisements and presents advertisements on the subsequent web page based on the quality scores (316). Alternatively, the advertising management system may simply refer to some or all of the previously-calculated quality scores of the candidate advertisements in order to select advertisements to present on the subsequent web page.

If the advertising management system 104 determines that one or more of the advertisements were previously presented on the first web page (YES), the advertising management system 104 calculates a second quality score for those advertisements that is based at least in part on the previous presentation of the advertisements (314). Using the example of FIG. 2, if a user requested to view a second page of search results associated with the query "new widget review," the advertising management system 104 could attempt to provide advertisements for presentation in one or more advertising locations on the second page of search results. In identifying appropriate advertisements, the advertising management system may determine that the advertisement 297 ("National Widgets") was previously presented on the first page of search results. After reaching this determination, the advertising management system calculates a second quality score that is based at least in part on the prior presentation of the advertisement 297.

The previous presentation of an advertisement may influence the calculation of the second quality score for that advertisement in a number of ways. In some examples, the second quality score for an advertisement can be penalized (e.g., decreased) based on the advertisement's previous presentation on the first web page. The advertisement's second quality score can be decreased by a static factor (e.g., 10%, 5 points, or the like). Similarly, in some cases, the second quality score for an advertisement could be increased by a static factor.

In some examples, the advertising management system 104 determines a dynamic adjustment to the second quality score that is based on the past performance of an advertisement. For example, if the advertising management system 104 determines that a second quality score should be calculated for an advertisement, the advertising management system 104 may evaluate previous instances in which that advertisement was presented on both a first web page and a subsequent web page. This evaluation may cause the advertising management system 104 to either increase or decrease the second quality score for the advertisement based on whether the advertisement was successfully presented (e.g., whether the advertisement was determined to have a high enough quality score to present on a subsequent page after taking into account a previous presentation of that advertisement on a previous page) on the subsequent web page in those previous instances. For example, if, in a previous instance, an advertisement was presented on both first and subsequent web pages and a user clicked on the advertisement on the subsequent web page, the advertising management system 104 could increase the second quality score for that advertisement based on its prior success in a similar situation. Similarly, if, in a previous instance, an advertisement was presented on both first and subsequent web pages and a user ignored (e.g., did not click) the advertisement on the subsequent web page, the advertising management system 104 could decrease the second quality score for that advertisement based on its prior lack of success in a similar situation.

After the advertising management system 104 has calculated second quality scores for the advertisements, the advertising management system 104 presents advertisements on the subsequent web page based at least in part on the calculated second quality scores (316). For example, if, after increasing or decreasing the second quality score for an advertisement (e.g., based on a previous presentation of that advertisement), the advertisement's second quality score does not exceed the quality scores (or second quality scores) of other advertisements, the advertising management system may not present the advertisement on the subsequent web page. Similarly, if, after increasing or decreasing the second quality score for an advertisement, the advertisement's (bid*second quality score) does exceed the (bid*quality scores) (or (bid*second quality scores)) of other advertisements, the advertising management system may present the advertisement on the subsequent web page. In some examples, the second quality score of an advertisement is compared to a threshold value instead of (or in addition to) quality scores of other advertisements. For example, an advertisement on the second page may have to not only exceed the (bid*quality score) of other advertisers in order to be presented, but may also have its (bid*quality score) exceed a value of 10 in order to be presented on the second page.

The advertising management system 104 can implement similar techniques to serve advertisements on further web pages (e.g., a "third" page of search results, or a web page that is requested subsequent to the subsequent web page). Furthermore, the advertising management system 104 may "stack" the increase or decrease to an advertisement's subsequent quality score. For example, if an advertisement has been presented on the previous two web pages (e.g., the first and second pages of search results), the advertising management system may increase (or decrease) the consequences associated with those previous presentations. In some examples, the advertising management system may also set an advertisement's second quality score to zero based on one or more previous presentations of that advertisement. This would effectively prevent the advertisement from winning an auction for a subsequent web page, and the advertisement would not be displayed. In some examples, the advertising management system 104 may also increase or decrease a threshold that (bid*quality scores) (or (bid*second quality scores)) must exceed in order for an advertisement to be presented on subsequent web pages. For example, a higher quality score could be required for re-displaying a previously presented advertisement in comparison to a quality score required to present an advertisement for the first time. Regardless of their quality scores, in order to prevent ineffective advertisements from being repeatedly presented on subsequent web pages, the advertising management system may also set a limit on the number of times an advertisement can be presented on subsequent web pages.

In some examples, the advertising management system may apply further rules to the advertisements to determine which advertisements will be presented on subsequent web pages. The advertising management system 104 enforces rules that prohibit advertisements that have appeared in a first advertising location (e.g., the side advertising location 296) from being presented in a second advertising location (e.g., the top advertising location 295). The advertising management system 104 can also prevent advertisements from appearing more than a set number of times (e.g., one time) in a given advertising location. For example, the advertising management system 104 may prevent an advertisement from being presented more than once in the top advertising position 295. The advertising management system 104 may also choose to increase or decrease the number of advertisement locations (or the number of advertisements to display within the advertisement locations) based on the amount of web content (e.g., the number of search results) on a given web page. For example, if a large number of search results are presented on a web page, the advertising management system 104 could present additional advertisements in the side advertising position 296 in order to fill the resultant empty space next to the excess search results. The advertising management system 104 may also alter the order in which advertisements are presented in a given advertising location.

In some examples, the advertising management system 104 can implement similar techniques to serve advertisements on subsequent web pages for web pages that relate to content other than search results. For example, scores can be recalculated for subsequent pages of a multi-page news article.

In some examples, a constant minimum price is maintained that is associated with the first advertisement for use in an auction associated with a presentation of the second web page. For example, the advertising management system 104 could use a minimum price (e.g., $2.00) for a given advertisement when conducting auctions including that advertisement for a subsequent web page.

Figure 4:
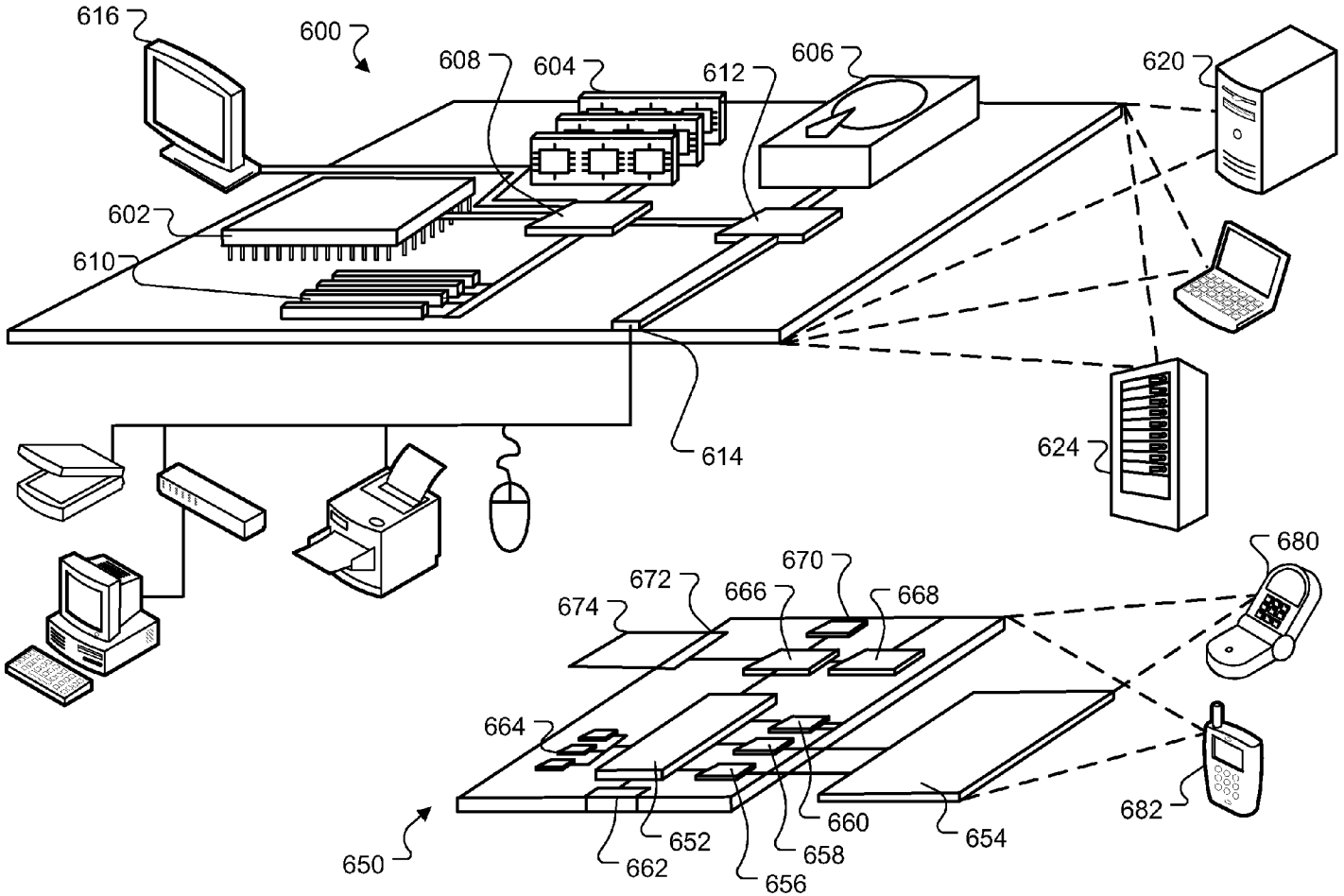
FIG. 4 is a block diagram of exemplary computing systems.

FIG. 4 shows an example of a computing device 600 and a mobile computing device 650 that can be used to implement the techniques described in this disclosure. The computing device 600 is intended to represent various forms of digital computers, such as laptops, desktops, workstations, personal digital assistants, servers, blade servers, mainframes, and other appropriate computers. The mobile computing device 650 is intended to represent various forms of mobile devices, such as personal digital assistants, cellular telephones, smartphones, and other similar computing devices. The components shown here, their connections and relationships, and their functions, are meant to be examples only, and are not meant to be limiting.

The computing device 600 includes a processor 602, a memory 604, a storage device 606, a high-speed interface 608 connecting to the memory 604 and multiple high-speed expansion ports 610, and a low-speed interface 612 connecting to a low-speed expansion port 614 and the storage device 606. Each of the processor 602, the memory 604, the storage device 606, the high-speed interface 608, the high-speed expansion ports 610, and the low-speed interface 612, are interconnected using various busses, and may be mounted on a common motherboard or in other manners as appropriate. The processor 602 can process instructions for execution within the computing device 600, including instructions stored in the memory 604 or on the storage device 606 to display graphical information for a GUI on an external input/output device, such as a display 616 coupled to the high-speed interface 608. In other implementations, multiple processors and/or multiple buses may be used, as appropriate, along with multiple memories and types of memory. Also, multiple computing devices may be connected, with each device providing portions of the necessary operations (e.g., as a server bank, a group of blade servers, or a multi-processor system).

The memory 604 stores information within the computing device 600. In some implementations, the memory 604 is a volatile memory unit or units. In some implementations, the memory 604 is a non-volatile memory unit or units. The memory 604 may also be another form of computer-readable medium, such as a magnetic or optical disk.

The storage device 606 is capable of providing mass storage for the computing device 600. In some implementations, the storage device 606 may be or contain a computer-readable medium, such as a floppy disk device, a hard disk device, an optical disk device, or a tape device, a flash memory or other similar solid state memory device, or an array of devices, including devices in a storage area network or other configurations. Instructions can be stored in an information carrier. The instructions, when executed by one or more processing devices (for example, processor 602), perform one or more methods, such as those described above. The instructions can also be stored by one or more storage devices such as computer- or machine-readable mediums (for example, the memory 604, the storage device 606, or memory on the processor 602).

The high-speed interface 608 manages bandwidth-intensive operations for the computing device 600, while the low-speed interface 612 manages lower bandwidth-intensive operations. Such allocation of functions is an example only. In some implementations, the high-speed interface 608 is coupled to the memory 604, the display 616 (e.g., through a graphics processor or accelerator), and to the high-speed expansion ports 610, which may accept various expansion cards (not shown). In the implementation, the low-speed interface 612 is coupled to the storage device 606 and the low-speed expansion port 614. The low-speed expansion port 614, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 600 may be implemented in a number of different forms, as shown in the figure. For example, it may be implemented as a standard server 620, or multiple times in a group of such servers. In addition, it may be implemented in a personal computer such as a laptop computer 622. It may also be implemented as part of a rack server system 624. Alternatively, components from the computing device 600 may be combined with other components in a mobile device (not shown), such as a mobile computing device 650. Each of such devices may contain one or more of the computing device 600 and the mobile computing device 650, and an entire system may be made up of multiple computing devices communicating with each other.

The mobile computing device 650 includes a processor 652, a memory 664, an input/output device such as a display 654, a communication interface 666, and a transceiver 668, among other components. The mobile computing device 650 may also be provided with a storage device, such as a microdrive or other device, to provide additional storage. Each of the processor 652, the memory 664, the display 654, the communication interface 666, and the transceiver 668, are interconnected using various buses, and several of the components may be mounted on a common motherboard or in other manners as appropriate.

The processor 652 can execute instructions within the mobile computing device 650, including instructions stored in the memory 664. The processor 652 may be implemented as a chipset of chips that include separate and multiple analog and digital processors. The processor 652 may provide, for example, for coordination of the other components of the mobile computing device 650, such as control of user interfaces, applications run by the mobile computing device 650, and wireless communication by the mobile computing device 650.

The processor 652 may communicate with a user through a control interface 658 and a display interface 656 coupled to the display 654. The display 654 may be, for example, a TFT (Thin-Film-Transistor Liquid Crystal Display) display or an OLED (Organic Light Emitting Diode) display, or other appropriate display technology. The display interface 656 may comprise appropriate circuitry for driving the display 654 to present graphical and other information to a user. The control interface 658 may receive commands from a user and convert them for submission to the processor 652. In addition, an external interface 662 may provide communication with the processor 652, so as to enable near area communication of the mobile computing device 650 with other devices. The external interface 662 may provide, for example, for wired communication in some implementations, or for wireless communication in other implementations, and multiple interfaces may also be used.

The memory 664 stores information within the mobile computing device 650. The memory 664 can be implemented as one or more of a computer-readable medium or media, a volatile memory unit or units, or a non-volatile memory unit or units. An expansion memory 674 may also be provided and connected to the mobile computing device 650 through an expansion interface 672, which may include, for example, a SIMM (Single In Line Memory Module) card interface. The expansion memory 674 may provide extra storage space for the mobile computing device 650, or may also store applications or other information for the mobile computing device 650. Specifically, the expansion memory 674 may include instructions to carry out or supplement the processes described above, and may include secure information also. Thus, for example, the expansion memory 674 may be provide as a security module for the mobile computing device 650, and may be programmed with instructions that permit secure use of the mobile computing device 650. In addition, secure applications may be provided via the SIMM cards, along with additional information, such as placing identifying information on the SIMM card in a non-packable manner.

The memory may include, for example, flash memory and/or NVRAM memory (non-volatile random access memory), as discussed below. In some implementations, instructions are stored in an information carrier. that the instructions, when executed by one or more processing devices (for example, processor 652), perform one or more methods, such as those described above. The instructions can also be stored by one or more storage devices, such as one or more computer- or machine-readable mediums (for example, the memory 664, the expansion memory 674, or memory on the processor 652). In some implementations, the instructions can be received in a propagated signal, for example, over the transceiver 668 or the external interface 662.

The mobile computing device 650 may communicate wirelessly through the communication interface 666, which may include digital signal processing circuitry where necessary. The communication interface 666 may provide for communications under various modes or protocols, such as GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such communication may occur, for example, through the transceiver 668 using a radio-frequency. In addition, short-range communication may occur, such as using a Bluetooth, WiFi, or other such transceiver (not shown). In addition, a GPS (Global Positioning System) receiver module 670 may provide additional navigation- and location-related wireless data to the mobile computing device 650, which may be used as appropriate by applications running on the mobile computing device 650.

The mobile computing device 650 may also communicate audibly using an audio codec 660, which may receive spoken information from a user and convert it to usable digital information. The audio codec 660 may likewise generate audible sound for a user, such as through a speaker, e.g., in a handset of the mobile computing device 650. Such sound may include sound from voice telephone calls, may include recorded sound (e.g., voice messages, music files, etc.) and may also include sound generated by applications operating on the mobile computing device 650.

The mobile computing device 650 may be implemented in a number of different forms, as shown in the figure. For example, it may be implemented as a cellular telephone 680. It may also be implemented as part of a smart-phone 682, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

Although a few implementations have been described in detail above, other modifications are possible. For example, while a client application is described as accessing the delegate(s), in other implementations the delegate(s) may be employed by other applications implemented by one or more processors, such as an application executing on one or more servers. In addition, the logic flows depicted in the figures do not require the particular order shown, or sequential order, to achieve desirable results. In addition, other actions may be provided, or actions may be eliminated, from the described flows, and other components may be added to, or removed from, the described systems. Accordingly, other implementations are within the scope of the following claims.

What is claimed is:

1. A method comprising:

receiving a first request to provide one or more advertisements on a first web page from a plurality of web pages, the plurality of web pages comprising a plurality of search results provided in response to a query;

calculating, by one or more processors, a first quality score for a first advertisement, the first advertisement being included in a set of one or more candidate advertisements that are available for presentation on the first web page;

presenting, based on the first quality score, the first advertisement on the first web page, the first quality score comprising (a) a metric reflecting a relevance of the first advertisement to the query and (b) a historical click-through rate of the first advertisement;

receiving an activation of a control within the first web page, the activation of the control corresponding to a user selection of a page identifier that corresponds to one or more of the plurality of web pages;

based on the activation of the control, receiving a second request to provide one or more advertisements on a second web page from the plurality of web pages;

calculating, based on the presentation of the first advertisement on the first web page, a second quality score for the first advertisement, the second quality score comprising (a) a metric reflecting a relevance of the first advertisement to the query and (b) a historical click-through rate of the first advertisement; and determining whether to present the first advertisement on the second web page based on the second quality score.

2. The method of claim 1, wherein calculating the second quality score comprises adjusting the second quality score based on one or more previous instances in which the first advertisement was presented on consecutive web pages from the plurality of web pages.

3. The method of claim 1, wherein calculating the second quality score comprises applying a penalty to the second quality score based on a previous presentation of the first advertisement.

4. The method of claim 3, wherein the penalty is increased for each quality score calculation subsequent to the calculation of the second quality score.

5. The method of claim 3, wherein the penalty decreases a value of the second quality score.

6. The method of claim 1, further comprising maintaining a constant minimum price associated with the first advertisement for submission in an auction associated with a presentation of the second web page.

7. The method of claim 1, further comprising presenting the first advertisement on the second web page as a result of the determination when the second quality score of the first advertisement exceeds a product of bids and quality scores associated with one or more additional advertisements.

8. The method of claim 1, further comprising presenting the first advertisement on the second web page as a result of the determination when a product of a bid and a second quality score associated with the first advertisement exceeds a threshold.

9. The method of claim 1, wherein the first web page and the second web page each comprise a first advertisement space for presenting one or more advertisements and a second advertisement space for presenting one or more advertisements, the first advertisement space being located at a top portion of the first web page and the second web page, and the second advertisement space being located on a side portion of the first web page and the second web page.

10. The method of claim 9, wherein advertisements presented on the first web page in the second advertisement space are not presented in the second advertisement space on the second web page.

11. The method of claim 9, wherein the first advertisement space is arranged above one or more items of web content, and the second advertisement space is arranged next to the one or more items of web content.

12. A non-transitory computer storage medium encoded with a computer program, the program comprising instructions that when executed by one or more computers cause the one or more computers to perform operations comprising:

receiving a first request to provide one or more advertisements on a first web page, from a plurality of web pages, the plurality of web pages comprising a plurality of search results provided in response to a query;

calculating a first quality score for a first advertisement, the first advertisement being included in a set of one or more candidate advertisements that are available for presentation on the first web page;

presenting, based on the first quality score, the first advertisement on the first web page, the first quality score comprising (a) a metric reflecting a relevance of the first advertisement to the query and (b) a historical click-through rate of the first advertisement;

receiving an activation of a control within the first web page, the activation of the control corresponding to a user selection of a page identifier that corresponds to one or more of the plurality of web pages;

based on the activation of the control, receiving a second request to provide one or more advertisements on a second web page from the plurality of web pages;

calculating, based on the presentation of the first advertisement on the first web page, a second quality score for the first advertisement, the second quality score comprising (a) a metric reflecting a relevance of the first advertisement to the query and (b) a historical click-through rate of the first advertisement; and determining whether to present the first advertisement on the second web page based on the second quality score.

13. The computer storage medium of claim 12, wherein calculating the second quality score comprises adjusting the second quality score based on one or more previous instances in which the first advertisement was presented on consecutive web pages from the plurality of web pages.

14. The computer storage medium of claim 12, wherein calculating the second quality score comprises applying a penalty to the second quality score based on a previous presentation of the first advertisement.

15. The computer storage medium of claim 14, wherein the penalty is increased for each quality score calculation subsequent to the calculation of the second quality score.

16. The computer storage medium of claim 14, wherein the penalty decreases a value of the second quality score.

17. The computer storage medium of claim 12, further comprising instructions to maintain a constant minimum price associated with the first advertisement for submission in an auction associated with a presentation of the second web page.

18. The computer storage medium of claim 12, further comprising instructions to present the first advertisement on the second web page as a result of the determination when the second quality score of the first advertisement exceeds a product of bids and quality scores associated with one or more additional advertisements.

19. The computer storage medium of claim 12, further comprising presenting the first advertisement on the second web page as a result of the determination when a product of a bid and a second quality score associated with the first advertisement exceeds a threshold.

20. The method of claim 1, further comprising determining whether the first advertisement was presented on the first web page;

wherein calculating a second quality score for the first advertisement is based on a determination that the first advertisement was previously presented on the first web page.

* * * * *